US006435988B2

(12) United States Patent
Maehara et al.

(10) Patent No.: US 6,435,988 B2
(45) Date of Patent: Aug. 20, 2002

(54) GOLF BALL AND METHOD OF EVALUATING GOLF BALL

(75) Inventors: Kazuto Maehara; Keisuke Ihara; Atsuki Kasashima, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 17 days.

(21) Appl. No.: 09/774,705

(22) Filed: Feb. 1, 2001

(30) Foreign Application Priority Data

Feb. 4, 2000 (JP) ..... 2000-027096

(51) Int. Cl.[7] ..... A63B 37/12; A63B 37/14
(52) U.S. Cl. ..... 473/378; 473/383
(58) Field of Search ..... 473/378–384

(56) References Cited

U.S. PATENT DOCUMENTS 4,744,564 A 5/1988 Yamada
4,867,459 A * 9/1989 Ihara ..... 473/379
5,908,359 A 6/1999 Shimosaka et al.
6,039,660 A * 3/2000 Kasashima et al. ..... 473/378
6,241,622 B1 * 6/2001 Gobush et al. ..... 473/199
6,254,496 B1 * 7/2001 Maehara et al. ..... 473/378

FOREIGN PATENT DOCUMENTS

JP 6-7875 2/1994
JP 2 910 707 4/1999

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball includes a large number of two types pr more dimples different in diameter and/or depth, which are arranged on the surface of the golf ball; wherein an EAstdev value of the golf ball is in a range of 2 or less, the EAstdev value being expressed by the following equations:

$$EA(\alpha_j) = \sum_{i=1}^{N} [Si \times \sin(\theta_i)]$$

$$EAstdev = \sqrt{\frac{N \sum_{j=1}^{N} [EA(\alpha_j)]^2 - \sum_{j=1}^{N} [EA(\alpha_j)]^2}{N(N-1)}}$$

5 Claims, 9 Drawing Sheets

GOLF BALL AND METHOD OF EVALUATING GOLF BALL

BACKGROUND OF THE INVENTION

The present invention relates to a golf ball capable of exhibiting a uniform flying distance of the golf ball by improving an aerodynamic isotropy of the golf ball.

A large number of dimples are arranged on the outer surface of a golf ball for increasing the flying performance of the golf ball. The flying performance of a golf ball, however, varies depending on the rotational direction (the latitudinal direction, longitudinal direction, or the intermediate direction therebetween) of the golf ball, which differs depending on a ball hitting point. The variation in rotational direction of the golf ball depending on a ball hitting point is mainly due to the distribution of the dimples arranged on the surface of the ball. From this viewpoint, various methods have been proposed to reduce a variation in flying performance of a golf ball by enhancing the uniformity in arrangement of dimples on the surface of the golf ball.

For example, a golf ball has been proposed in Japanese Patent Publication No. Hei 6-7875, in which the shapes of dimples are adjusted so that an effective total volume of the dimples of the golf ball which is hit at its north or south pole portion and is thereby rotated around the rotational axis corresponding to the equatorial line is nearly equal to an effective total volume of the dimples of the golf ball which is hit at its seam portion and is thereby rotated around the rotational axis corresponding to the line connecting the north and south poles to each other.

Another golf ball has been proposed in Japanese Patent No. 2910707, in which dimples are designed so that at least one of a specific volume symmetry index Vi, a specific area symmetry index $S_i$, a specific edge length symmetry index Li, and a specific arrangement symmetry index Ni is more than 1, to adjust the dimple arrangement so that the dimple effect does not differ between when the golf ball is hit at its seam portion and when it is hit at its north or south pole portion, thereby obtaining a stable trajectory of the golf ball.

Each of the above-described prior art golf balls, however, has a problem. Namely, such a golf ball is intended to allow the aerodynamic characteristic of the golf ball rotated around one limited rotational axis (for example, a pole axis) to correspond to the aerodynamic characteristic of the golf ball rotated around another limited rotational axis (for example, seam axis); however, in actual golf play, since the golf ball is hit at any point, it may be rotated around a random rotational axis, and accordingly, the prior art golf ball fails to have a uniform aerodynamic characteristic for rotation of the ball around any rotational axis, that is, fails to exhibit a uniform flying performance.

On the other hand, a golf ball has been conventionally needed to have a great circle (parting line) with no dimple intersecting therewith for forming the golf ball by molding. Such a parting line has been generally prepared by disordering part of a regular polyhedron arrangement or preparing a pseudo-great circle; however, in this case, since the dimple arrangement is distorted or a land with no dimple is continuously formed, there arises a problem that the uniformity of the aerodynamic characteristic of the golf ball is degraded.

By the way, dimples have been arranged, in general, on the spherical surface of a golf ball by a method of assuming the spherical surface of the golf ball as a spherical regular polyhedron and using one plane of the spherical regular polyhedron as a dimple arrangement unit. Such a dimple arrangement method is effective to facilitate the dimple design and to ensure a certain aerodynamic isotropy of the golf ball.

In this method, however, if the number of spherical unit planes constituting the spherical regular polyhedron is small, there may occur a large difference in aerodynamic characteristic between when the golf ball is rotated around a rotational axis along the boundary between the units and when it is rotated around a rotational axis along a line offset therefrom. That is to say, in this case, since the rotational axis of the golf ball differs depending on a ball hitting point because of the fact that the number of spherical unit planes constituting the spherical polyhedron is small, there arises a problem that the aerodynamic characteristic due to the regularity of the dimple arrangement varies and thereby the flying distance of the golf ball also varies.

For example, in the above method, if the number of the spherical unit planes of the spherical regular polyhedron constituting the spherical surface of the golf ball is two, that is, if the golf ball is assumed by combination of two semi-spheres, the difference in aerodynamic characteristic between when the golf ball is rotated along the equatorial direction and when it is rotated along the longitudinal direction becomes large to such an extent as to be acknowledged by a player in the actual test. Additionally, such a difference in aerodynamic characteristic has come to be numerically measured by a test using a hitting machine (M/C).

Various methods have been proposed to improve the above-described difference in aerodynamic characteristic of a golf ball depending on a ball hitting point; however, in either of these methods, it is not intended to basically improve the difference in aerodynamic characteristic of a golf ball but to partially correct the difference in aerodynamic characteristic of the golf ball while keeping the basic dimple arrangement unit, and thereby it fails to significantly improve the aerodynamic isotropy of the golf ball.

SUMMARY OF THE INVENTION

An object of the present invention is to provide a golf ball capable of exhibiting a uniform aerodynamic characteristic even when the ball is rotated along any rotational axis, thereby exhibiting a uniform flying performance, and to provide a method of evaluating a golf ball.

To achieve the above object, according to one aspect of the present invention, there is provided a golf ball including: a large number of two types or more dimples different in diameter and/or depth, which are arranged on the golf ball is in a range of 2 or less, the EAstdev value being expressed by the following equations:

$$EA(\alpha_j) = \sum_{i=1}^{N} [Si \times \sin(\theta_i)]$$

$$EAstdev = \sqrt{\frac{N \sum_{j=1}^{N} [EA(\alpha_j)]^2 - \sum_{j=1}^{N} [EA(\alpha_j)]^2}{N(N-1)}}$$

wherein N is the total number of dimples; each of suffixes "i" and "j" is a dimple ID number; $\alpha_j$ is a rotational axis of a golf ball determined by a straight line connecting the center of the dimple having an ID number "j" to the center of gravity of the golf ball; EA ($\alpha_j$) is an aerodynamic index of a dimple arrangement around the rotational axis $\alpha_j$; $\theta_i$ is an angle formed between the rotational axis $\alpha_j$ of the golf ball and a straight line connecting the center of the dimple having the ID number "i" to the center of gravity of the golf ball; and $S_i$ is an area of a planar shape formed by a peripheral edge of the dimple having the ID number "i".

According to another aspect of the present invention, there is provided a method of evaluating a golf ball having on its surface a large number of two types or more dimples different in diameter and/or depth, including the steps of: calculating an EAstdev value of the golf ball; and estimating, if the EAstdev value is 2 or less, that the uniformity of a dimple arrangement of the golf ball is high and thereby an aerodynamic isotropy of the golf ball is good, wherein the EAstdev value is expressed by the following equations:

$$EA(\alpha_j) = \sum_{i=1}^{N} [Si \times \sin(\theta_i)]$$

$$EAstdev = \sqrt{\frac{N\sum_{j=1}^{N}[EA(\alpha_j)]^2 - \sum_{j=1}^{N}[EA(\alpha_j)]^2}{N(N-1)}}$$

where N is the total number of dimples; each of suffixes "i" and "j" is a dimple ID number; $\alpha_j$ is a rotational axis of a golf ball determined by a straight line connecting the center of the dimple having an ID number "j" to the center of gravity of the golf ball; $EA(\alpha_j)$ is an aerodynamic index of a dimple arrangement around the rotational axis $\alpha_j$; $\theta_i$ is an angle formed between the rotational axis $a_j$ of the golf ball and a straight line connecting the center of the dimple having the ID number "i" to the center of gravity of the golf ball; and $S_i$ is an area of a planar shape formed by a peripheral edge of the dimple having the ID number "i".

With this configuration, the EAstdev value as the index indicating the uniformity of a dimple arrangement of a golf ball having on its surface a large number of two types or more dimples different in diameter and/or depth is in a range of 2 or less. Accordingly, unlike the prior art golf ball, in which the aerodynamic characteristic of the golf ball rotated around one limited rotational axis (for example, a pole axis) corresponds to the aerodynamic characteristic of the golf ball rotated around another limited rotational axis (for example, seam axis), the aerodynamic isotropy of the golf ball of the present invention can be kept constant even when the ball is rotated around any rotational axis, with a result that the golf ball of the present invention can exhibit a uniform flying performance allowing a golfer to certainly carry the golf ball toward a target location.

DETAILED DESCRIPTION OF THE PREFERRED EMBODIMENTS

Preferred embodiments of the present invention will be described with reference to the accompanying drawings.

A golf ball of the present invention is characterized by including on its surface a large number of two types or more dimples different in diameter and/or depth, wherein an EAstdev value as an index indicating the uniformity of a dimple arrangement is in a range of 2 or less.

Figure 1:
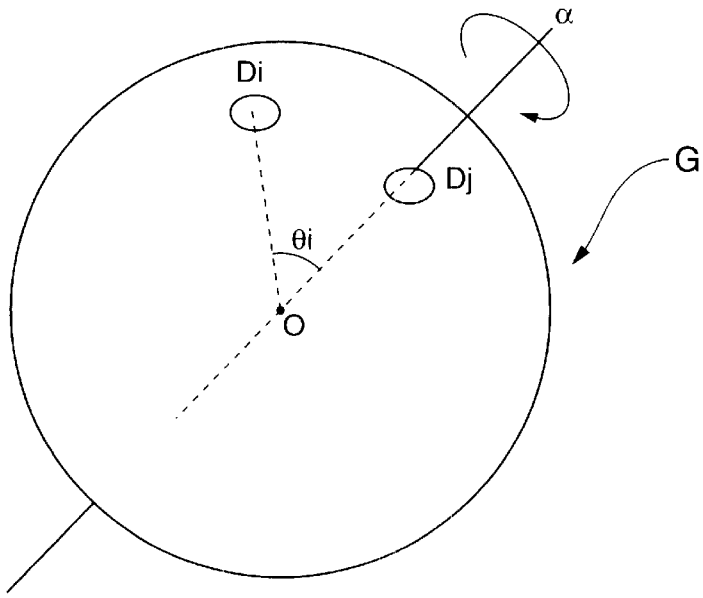
FIG. 1 is a view illustrating an angle between a rotational axis of a golf ball and a dimple.

The EAstdev value is defined as a standard deviation of a value obtained by calculating an aerodynamic index EA of the dimple arrangement (which is rotated around a rotational axis connecting the center of a dimple on the surface of the ball to the center of gravity of the ball) for all the rotational axes connecting the centers of all of dimples on the surface of the ball to the center of gravity of the ball, that is, defined as a standard deviation of EA values of the total number of N obtained for rotational axes $\alpha_1$ to $\alpha_N$. The EAstdev value can be obtained as follows:

FIG. 1 is a view illustrating an angle between a rotational axis of a golf ball G and a dimple. In this figure, character O designates the center of gravity of the golf ball G; $\alpha_j$ is a rotational axis determined by a straight line connecting the center of a dimple $D_j$ to the center of gravity O of the golf ball G; and $\theta_i$ is an angle between the rotational axis $\alpha_j$ and a straight line connecting the center of a dimple $D_i$ to the center of gravity 0 of the golf ball G.

Referring to FIG. 1, the aerodynamic index $EA(\alpha_j)$ of a dimple arrangement around the rotational axis a is expressed by the following equation:

$$EA(\alpha_j) = \sum_{i=1}^{N} [S_i \times \sin(\theta_i)]$$

In the above equation, N is a total number of the dimples. According to the present invention, the total number N of the dimples may be in a range of 460 or less, preferably in a range of 350 to 460, more preferably in a range of 360 to 440. The types of the dimples different in diameter and/or diameter may be two or more, preferably in a range of two to five. Additionally, the diameter of the dimple may be in a range of about 2.0 to about 4.5 mm, and the depth of the dimple may be in a range of about 0.08 to about 0.3 mm.

The suffixes i and j are dimple ID numbers, each of which is an integer in a range of 1 to N (total number of the dimples).

The character $\theta_i$ is an angle (unit: radian) between the rotational axis $\alpha_j$ of the golf ball and a straight line connecting the center of the dimple $D_i$ to the center of gravity of the golf ball, which is in a range of 0 to $\pi/2$.

The character $S_i$ is an area (unit: $mm^2$) of a planar shape formed by a peripheral edge of the dimple $D_i$. For a circular dimple, letting the diameter thereof be Dm, the area $S_i$ is calculated by an equation of $\pi\times(Dm/2)^2$, and for a non-circular dimple, the area $S_i$ can be similarly calculated by replacing the cross-sectional shape with an approximate circle.

The angle $\theta_i$ between the rotational axis $\alpha_j$ of the golf ball and the straight line connecting the center of the dimple $D_i$ to the center of gravity O of the golf ball is calculated as follows:

Assuming that a normalized vector from the center of gravity O of the ball to the center of the dimple $D_i$ is taken as V1 (x1, y1, z1) and a vector of the rotational axis passing through the center of gravity of the ball is taken as V2 (x2, y2, z2), the scalar product of V1 and V2 becomes $\cos(\theta_i)$. Accordingly, the angle $\theta_i$ can be obtained by calculating a value of $\arccos[(x1\times x2)+(y1\times y2)+(z1\times z2)]$.

By substituting the values of the area $S_i$ and the angle $\theta_i$ in the above-described equation, an aerodynamic index $EA(\alpha_j)$ of the dimple arrangement around the rotational axis $\alpha_j$ is obtained. Subsequently, a rotational axis $a_{j+1}$ is determined for the next dimple, and an aerodynamic index $EA(\alpha_{j+1})$ of the dimple arrangement around the rotational axis $\alpha_{j+1}$ is similarly calculated. In this way, the calculation is repeated for rotational axes $\alpha_1$ to $\alpha_N$ determined for all the dimples on the surface of the ball, to obtain the aerodynamic indexes EA of the total number N for the rotational axes $\alpha_1$ to $\alpha_N$. From these results, the EAstdev value is calculated on the basis of the following equation:

$$EAstdev = \sqrt{\frac{N\sum_{j=1}^{N}[EA(\alpha j)]^2 - \sum_{j=1}^{N}[EA(\alpha j)]^2}{N(N-1)}}$$

According to the present invention, the EAstdev value is specified to be in a range of 2 or less, preferably, 1.5 or less, more preferably, 1 or less. The lower limit of the EAstdev value is not particularly limited but may be 0 or more. If the EAstdev value is more than 2, the aerodynamic isotropy is degraded, with a result that the standard deviation of flying distances becomes large.

The EAstdev value of a golf ball may be calculated on the basis of data of the golf ball in the state before or after painting; however, it may be desirable to adopt the smaller one of the EAstdev values determined on the basis of data of the golf ball in the state before and after painting. The type of dimple arrangement is not particularly limited. For example, a regular octahedron arrangement pattern or a regular icosahedron arrangement pattern may be used. Alternatively, a random arrangement pattern in which a repeated unit constituting one plane of a regular polyhedron for dimple arrangement is not used may also be used. Further, it may be desirable that the total number of dimples be set to an odd number by eliminating the presence of any great circle with which dimples do not intersect.

A method of evaluating a golf ball according to the present invention is characterized by including the steps of calculating the EAstdev value of the golf ball as described above; and estimating, if the EAstdev value is 2 or less, that the uniformity of a dimple arrangement of the golf ball is high and thereby an aerodynamic isotropy of the golf ball is good, more concretely, that the aerodynamic isotropy of the golf ball can be kept constant even when the ball is rotated around any rotational axis and thereby the golf ball can exhibit a uniform flying performance allowing a golfer to certainly flying performance the golf ball toward a target location.

It should be noted that the golf ball whose EAstdev value is 2 or less can be obtained by uniformly arranging two types or more dimples different in diameter and/or depth on the surface of the ball.

Next, the present invention will be more clearly described by way of embodiments for calculating the EAstdev values of various golf balls.

First Embodiment:

EXAMPLE 1

Figure 2:
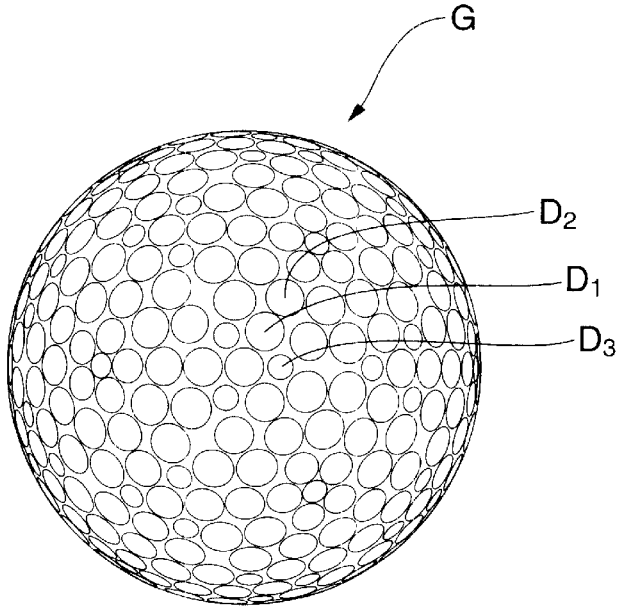
FIG. 2 is a plan view, as seen from the pole direction, showing a golf ball according to a first embodiment.
Figure 3:
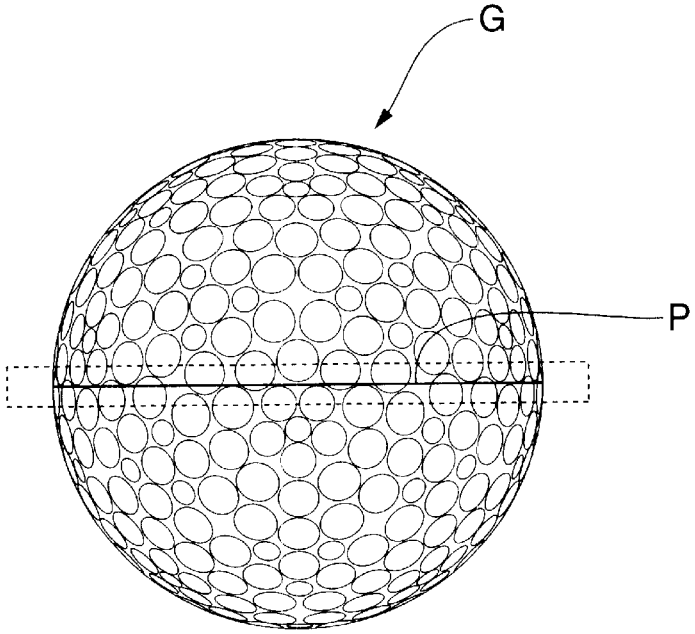
FIG. 3 is a side view of the golf ball shown in FIG. 2.

FIG. 2 is a plan view, as seen from the pole direction, showing a golf ball according to a first embodiment of the present invention, and FIG. 3 is a plan view, as seen from the equatorial direction, showing the golf ball shown in FIG. 2. Referring to FIGS. 2 and 3, three types of dimples different in diameter and/or depth, concretely, large dimples $D_1$ (diameter: 3.8 mm, depth: 0.17 mm), medium dimples $D_2$ (diameter: 3.2 mm, depth: 0.14 mm), and small dimples $D_3$ (diameter: 2.35 mm, depth: 0.1 mm) are equally arranged on the surface of a golf ball G in accordance with a known regular icosahedron arrangement manner. The total number of the dimples is set to 432.

In the golf ball according to the first embodiment, as shown in FIG. 3, part of the dimples intersect with a seam line P. That is to say, the golf ball is a so-called seamless golf ball having no great circle with which any one of the dimples does not intersect.

The EAstdev value of the golf ball of the first embodiment, having a diameter of 42.7 mm, is calculated below. The EA value is calculated for a rotational axis of the golf ball determined by a straight line connecting the center of a dimple having a dimple ID number to the center of gravity of the golf ball. Further, a normalized vector from the center of gravity of the golf ball to the center of a dimple is used as a positional vector (X, Y, Z), and a diameter ratio is calculated as a ratio of the diameter of a dimple to the diameter of the golf ball.

Concretely, the aerodynamic index $EA(\alpha_1)$ value for a rotational axis ($\alpha_1$) passing through a dimple having a dimple ID number of 1 can be calculated as follows:

$$\begin{aligned} EA(\alpha_1) &= \sum_{i=1}^{N}[S_i\times\sin(\theta_i)] \\ &= S_1\times\sin(\theta_1) + S_2\times\sin(\theta_2) + \ldots + S_N\times\sin(\theta_N) \end{aligned}$$

In this way, the EA values for rotational axes passing through all of the dimples of the total number of 432 were obtained. The results are shown in Table 1, with the data partially omitted.

TABLE 1

| ID | Positional vector X | Y | Z | Diameter ratio | EA(ID) |
|---|---|---|---|---|---|
| 1 | 0.718373 | 0.653669 | 0.238025 | 0.088993 | 3295.3268 |
| 2 | −0.925281 | 0.295295 | 0.238025 | 0.088993 | 3295.3268 |
| 3 | 0.206908 | −0.948964 | 0.238025 | 0.088993 | 3295.3268 |
| 4 | 0.206908 | 0.948964 | 0.238025 | 0.088993 | 3295.3268 |
| 5 | −0.925281 | −0.295295 | 0.238025 | 0.088993 | 3295.3268 |
| 6 | 0.718373 | −0.653669 | 0.238025 | 0.088993 | 3295.3268 |
| 7 | 0.563102 | 0.787113 | 0.251732 | 0.088993 | 3295.4329 |
| 8 | −0.963211 | 0.094104 | 0.251732 | 0.088993 | 3295.4329 |
| 9 | 0.400109 | −0.881217 | 0.251732 | 0.088993 | 3295.4329 |
| 10 | 0.400109 | 0.881217 | 0.251732 | 0.088993 | 3295.4329 |
| . | | | (omitted) | | |
| . | | | | | |
| . | | | | | |
| . | | | | | |
| 423 | −0.891225 | −0.435450 | −0.126891 | 0.088993 | 3295.4514 |
| 424 | −0.993554 | 0.080289 | −0.080025 | 0.074941 | 3296.3576 |
| 425 | 0.566309 | 0.820299 | −0.080025 | 0.074941 | 3296.3576 |
| 426 | 0.427245 | −0.900587 | −0.080025 | 0.074941 | 3296.3576 |
| 427 | 0.427245 | 0.900587 | −0.080025 | 0.074941 | 3296.3576 |
| 428 | 0.566309 | −0.820299 | −0.080025 | 0.074941 | 3296.3576 |
| 429 | −0.993554 | −0.080289 | −0.080025 | 0.074941 | 3296.3576 |
| 430 | −0.152017 | 0.263300 | −0.952661 | 0.088993 | 3295.4878 |
| 431 | 0.304033 | 0.000000 | −0.952661 | 0.088993 | 3295.4878 |
| 432 | −0.152017 | −0.263300 | −0.952661 | 0.088993 | 3295.4878 |

From the results shown in Table 1, the EAstdev value of the golf ball according to the first embodiment was calculated as follows:

$$EAstdev = \sqrt{\frac{432\sum_{j=1}^{432}[EA(\alpha j)]^2 - \left[\sum_{j=1}^{432} EA(\alpha j)\right]^2}{432\times(432-1)}}$$

$$= 0.4211$$

Second Embodiment:

EXAMPLE 2

Figure 4:
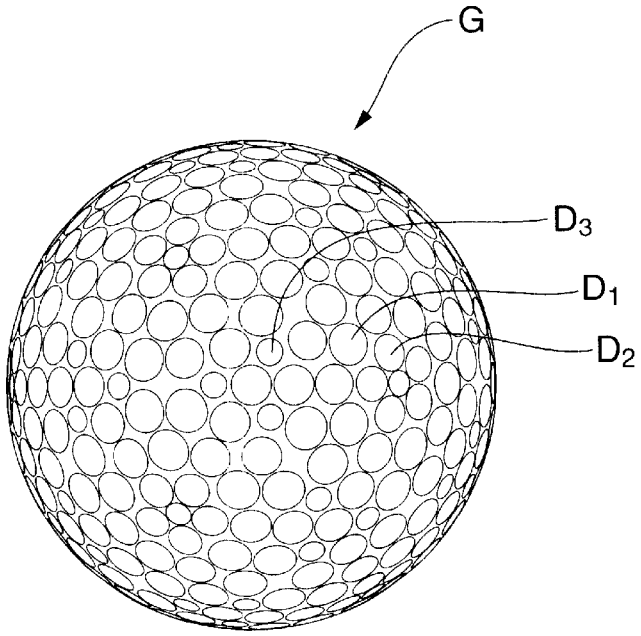
FIG. 4 is a plan view, as seen from the pole direction, showing a golf ball according to a second embodiment.
Figure 5:
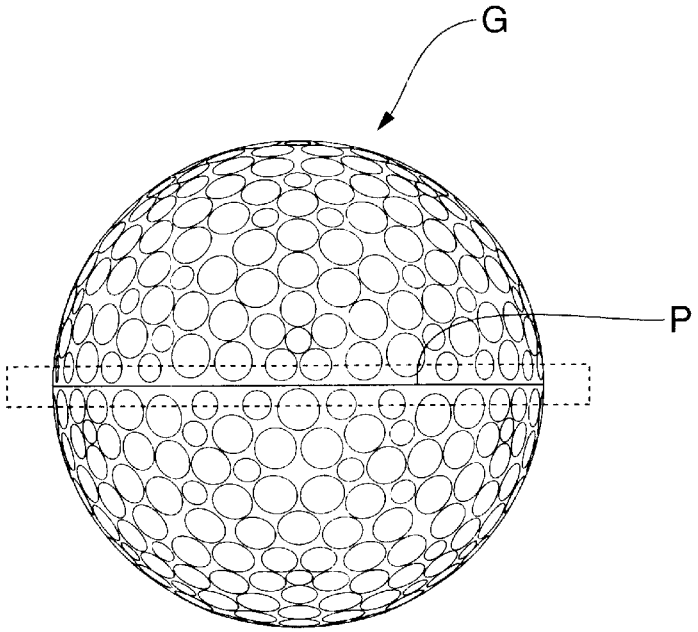
FIG. 5 is a side view of the golf ball shown in FIG. 4.

FIG. 4 is a plan view, as seen from the pole direction, showing a golf ball according to a second embodiment of the present invention, and FIG. 5 is a plan view, as seen from the equatorial direction, showing the golf ball shown in FIG. 4. Referring to FIGS. 4 and 5, three types of dimples different in diameter and/or depth, concretely, large dimples $D_1$ (diameter: 3.8 mm, depth: 0.17 mm), medium dimples $D_2$ (diameter: 3.2 mm, depth: 0.14 mm), and small dimples $D_3$ (diameter: 2.35 mm, depth: 0.1 mm) are equally arranged on the surface of a golf ball G in accordance with the known regular icosahedron arrangement manner. The total number of the dimples is set to 432.

In the golf ball according to the second embodiment, as shown in FIG. 5, any one of the dimples does not intersect with a seam line P. That is to say, the golf ball has a great circle with which any one of the dimples does not intersect. The EAstdev value of the golf ball was calculated in the same manner as that described in the first embodiment. As a result, the EAstdev value was 1.88.

Third Embodiment:

EXAMPLE 3

Figure 6:
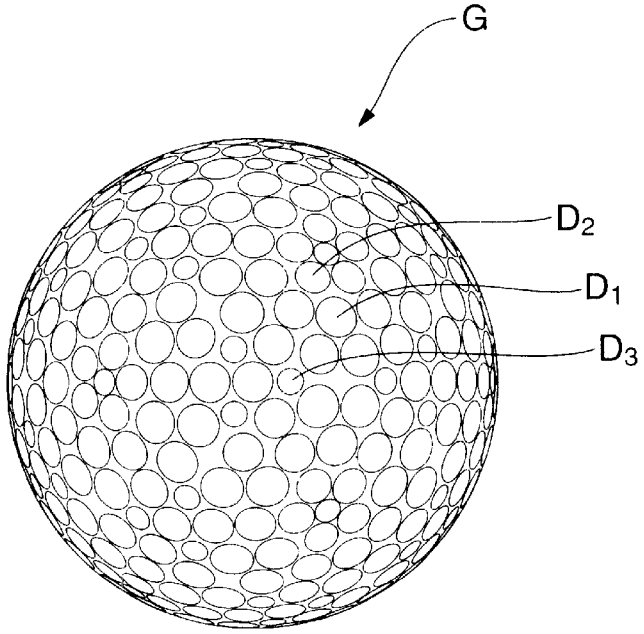
FIG. 6 is a plan view, as seen from the pole direction, showing a golf ball according to a third embodiment.
Figure 7:
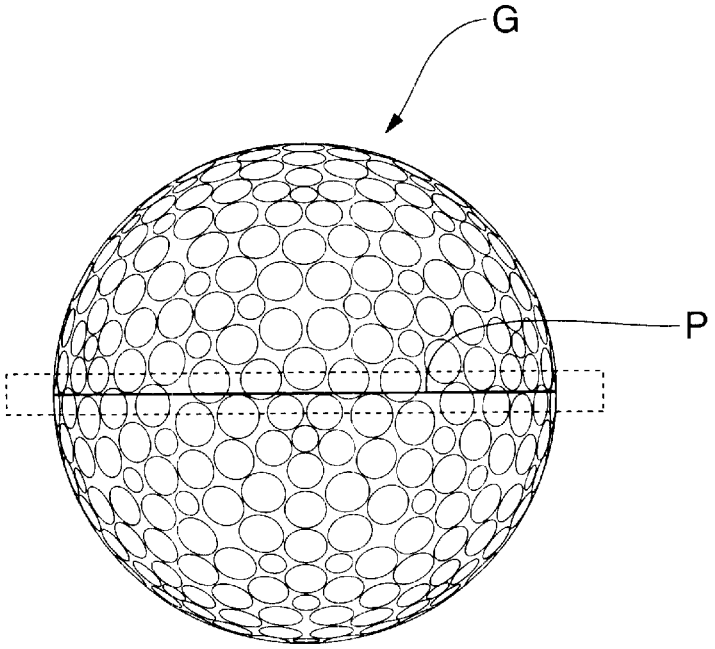
FIG. 7 is a side view of the golf ball shown in FIG. 6.

FIG. 6 is a plan view, as seen from the pole direction, showing a golf ball according to a third embodiment of the present invention, and FIG. 7 is a plan view, as seen from the equatorial direction, showing the golf ball shown in FIG. 6. Referring to FIGS. 6 and 7, three types of dimples different in diameter and/or depth, concretely, large dimples $D_1$ (diameter: 3.7 mm, depth: 0.16 mm), medium dimples $D_2$ (diameter: 3.2 mm, depth: 0.14 mm), and small dimples $D_3$ (diameter: 2.35 mm, depth: 0.1 mm) are equally arranged on the surface of a golf ball G in accordance with the known regular icosahedron arrangement manner. The total number of the dimples is set to 452.

In the golf ball according to the third embodiment, as shown in FIG. 7, part of the dimples intersect with a seam line P. That is to say, the golf ball is a so-called seamless golf ball having no great circle with which any one of the dimples does not intersect. The EAstdev value of the golf ball was calculated in the same manner as that described in the first embodiment. As a result, the EAstdev value was 0.78.

Fourth Embodiment:

EXAMPLE 4

Figure 8:
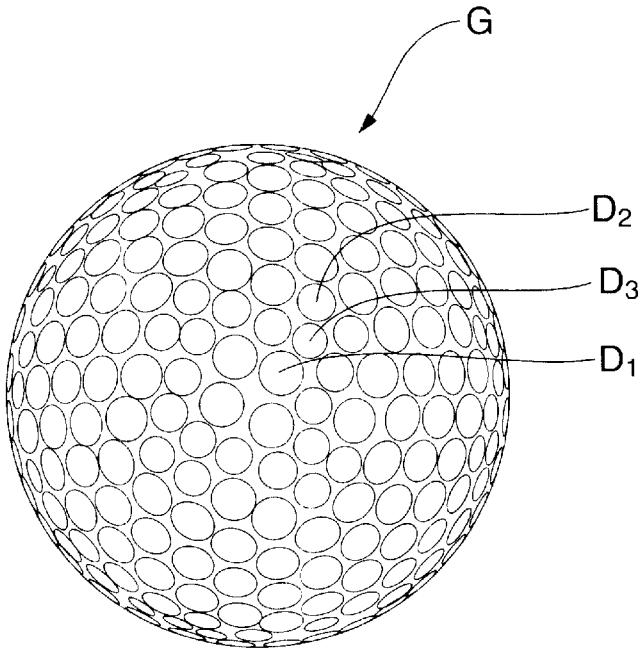
FIG. 8 is a plan view, as seen from the pole direction, showing a golf ball according to a fourth embodiment.
Figure 9:
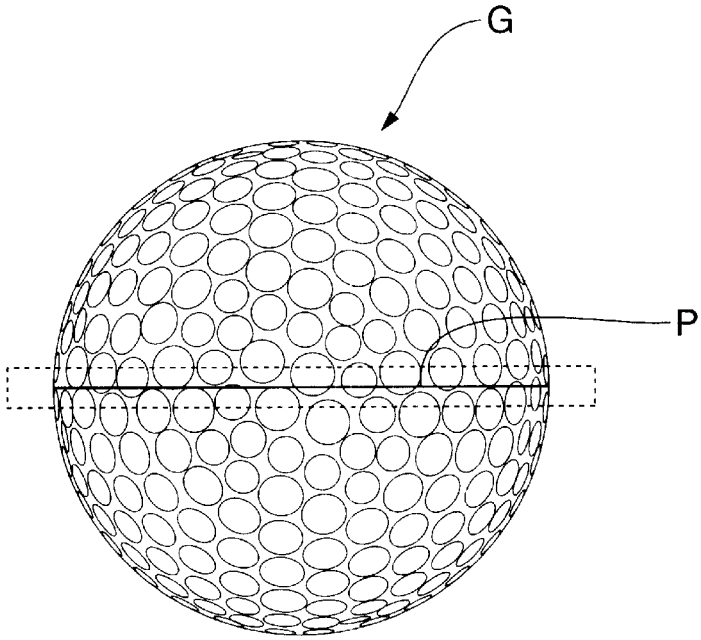
FIG. 9 is a side view of the golf ball shown in FIG. 8

FIG. 8 is a plan view, as seen from the pole direction, showing a golf ball according to a fourth embodiment of the present invention, and FIG. 9 is a plan view, as seen from the equatorial direction, showing the golf ball shown in FIG. 8. Referring to FIGS. 8 and 9, three types of dimples different in diameter and/or depth, concretely, large dimples $D_1$ (diameter: 4.0 mm, depth: 0.19 mm), medium dimples $D_2$ (diameter: 3.8 mm, depth: 0.18 mm), and small dimples $D_3$ (diameter: 3.2 mm, depth: 0.14 mm) are equally arranged on the surface of a golf ball G in accordance with a random arrangement manner (excluding a repeated unit constituting one plane of a regular polyhedron for dimple arrangement). The total number of the dimples is set to 392.

In the golf ball according to the fourth embodiment, as shown in FIG. 9, part of the dimples intersect with a seam line P. That is to say, the golf ball is a so-called seamless golf ball having no great circle with which any one of the dimples does not intersect. The EAstdev value of the golf ball was calculated in the same manner as that described in the first embodiment. As a result, the EAstdev value was 0.74.

FIRST COMPARATIVE EXAMPLE

Figure 10:
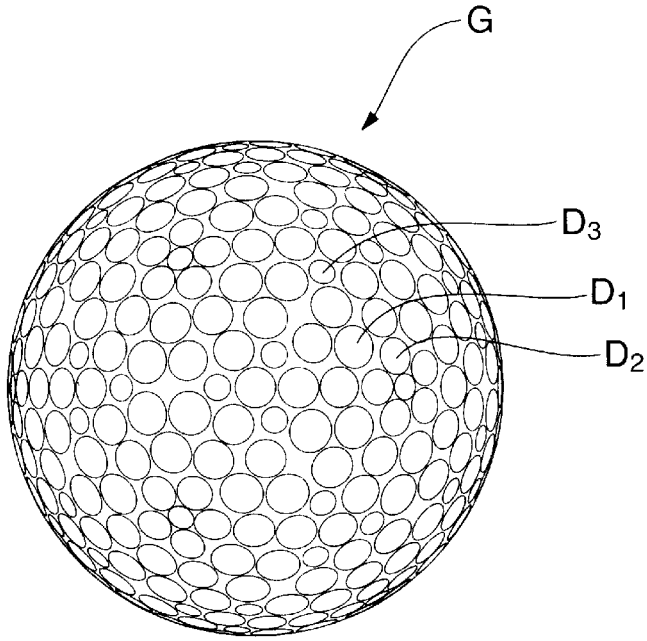
FIG. 10 is a plan view, as seen from the pole direction, showing a golf ball according to a first comparative example.
Figure 11:
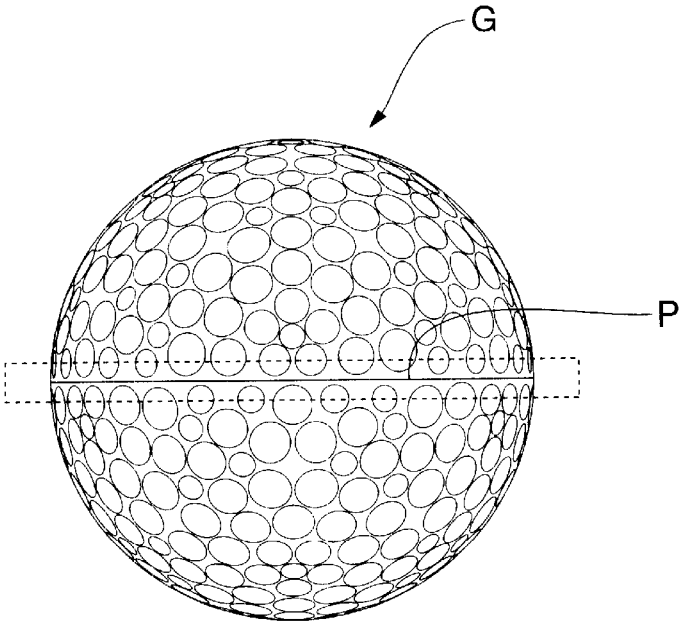
FIG. 11 is a side view of the golf ball shown in FIG. 10.

FIG. 10 is a plan view, as seen from the pole direction, showing a golf ball according to a first comparative example of the present invention, and FIG. 11 is a plan view, as seen from the equatorial direction, showing the golf ball shown in FIG. 10. Referring to FIGS. 10 and 11, three types of dimples different in diameter and/or depth, concretely, large dimples $D_1$ (diameter: 3.8 mm, depth: 0.17 mm), medium dimples $D_2$ (diameter: 3.2 mm, depth: 0.14 mm), and small dimples $D_3$ (diameter: 2.35 mm, depth: 0.1 mm) are equally arranged on the surface of a golf ball G in accordance with the known regular icosahedron arrangement manner. The total number of the dimples is set to 432.

The golf ball according to the first comparative example has the dimples of the same kinds as those of the dimples of the golf ball according to the first embodiment: however, as shown in FIG. 11, any one of the dimples does not intersect with a seam line P. That is to say, the golf ball has a great circle with which any one of the dimples does not intersect, and thereby the dimple arrangement of the golf ball is not optimized. The EAstdev value of the golf ball was calculated in the same manner as that described in the first embodiment. As a result, the EAstdev value was 2.6.

SECOND COMPARATIVE EXAMPLE

Figure 12:
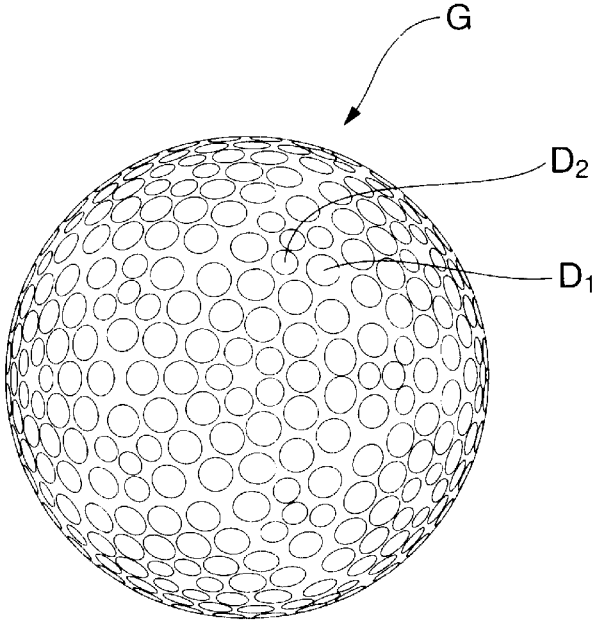
FIG. 12 is a plan view, as seen from the pole direction, showing a golf ball according to a second comparative example.
Figure 13:
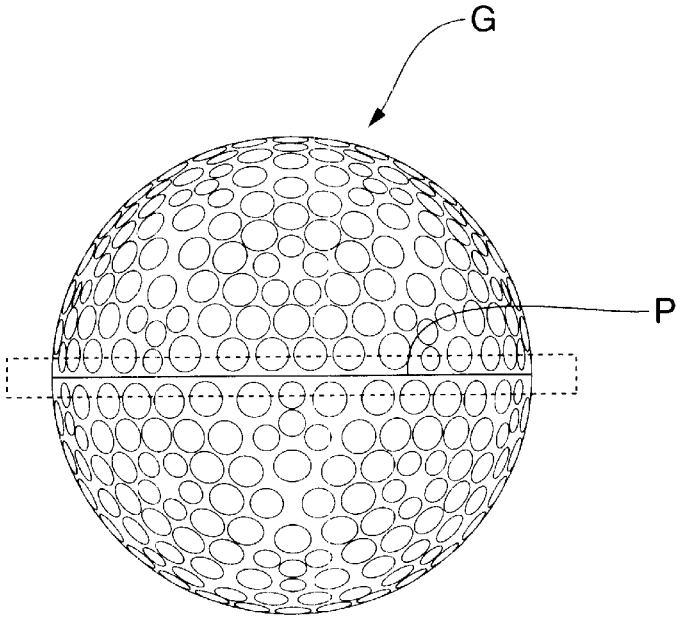
FIG. 13 is a side view of the golf ball shown in FIG. 12.

FIG. 12 is a plan view, as seen from the pole direction, showing a golf ball according to a second comparative example of the present invention, and FIG. 13 is a plan view, as seen from the equatorial direction, showing the golf ball shown in FIG. 12. Referring to FIGS. 12 and 13, two types of dimples different in diameter and/or depth, concretely, large dimples $D_1$ (diameter: 3.2 mm, depth: 0.2 mm) and small dimples $D_2$ (diameter: 2.4 mm, depth: 0.2 mm) are equally arranged on the surface of a golf ball G in accordance with the known regular icosahedron arrangement manner. The total number of the dimples is set to 500.

In the golf ball according to the second comparative example, as shown in FIG. 13, any one of the dimples does not intersect with a seam line P. That is to say, the golf ball has a great circle with which any one of the dimples does not intersect. The EAstdev value of the golf ball was calculated in the same manner as that described in the first embodiment. As a result, the EAstdev value was 2.8.

THIRD COMPARATIVE EXAMPLE

Figure 14:
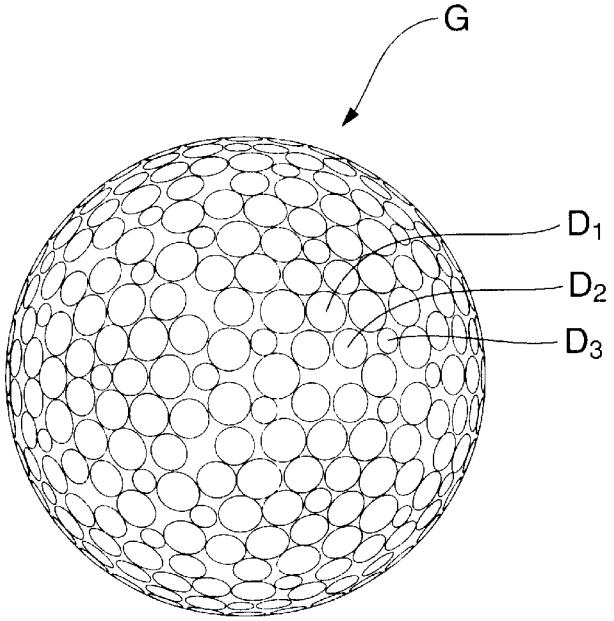
FIG. 14 is a plan view, as seen from the pole direction, showing a golf ball according to a third comparative example.
Figure 15:
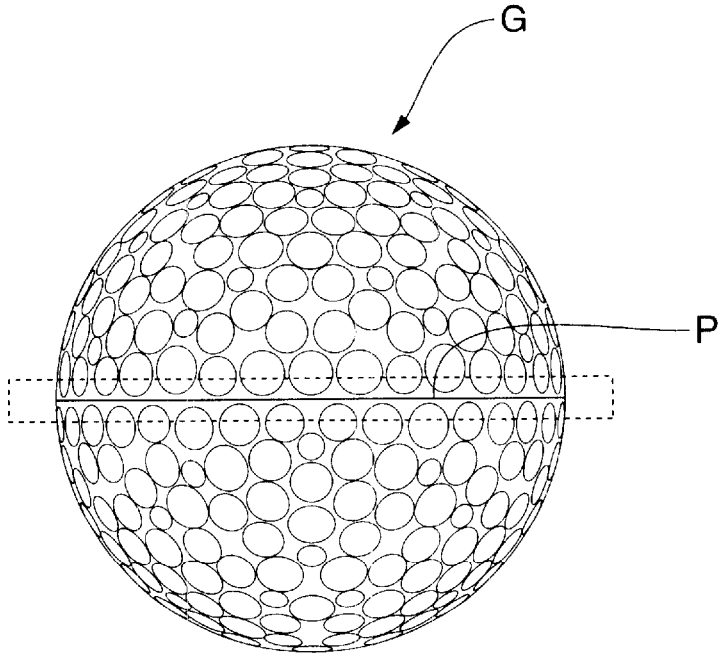
FIG. 15 is a side view of the golf ball shown in FIG. 14.

FIG. 14 is a plan view, as seen from the pole direction, showing a golf ball according to a third comparative example of the present invention, and FIG. 15 is a plan view, as seen from the equatorial direction, showing the golf ball shown in FIG. 14. Referring to FIGS. 14 and 15, three types of dimples different in diameter and/or depth, concretely, large dimples $D_1$ (diameter: 4.0 mm, depth: 0.17 mm), medium dimples $D_2$ (diameter: 3.6 mm, depth: 0.16 mm) and small dimples $D_3$ (diameter: 2.4 mm, depth: 0.11 mm) are equally arranged on the surface of a golf ball G in accordance with the known regular icosahedron arrangement manner. The total number of the dimples is set to 420.

In the golf ball according to the third comparative example, as shown in FIG. 15, any one of the dimples does not intersect with a seam line P. That is to say, the golf ball has a great circle with which any one of the dimples does not intersect. The EAstdev value of the golf ball was calculated in the same manner as that described in the first embodiment. As a result, the EAstdev value was 9.82.

FOURTH COMPARATIVE EXAMPLE

Figure 16:
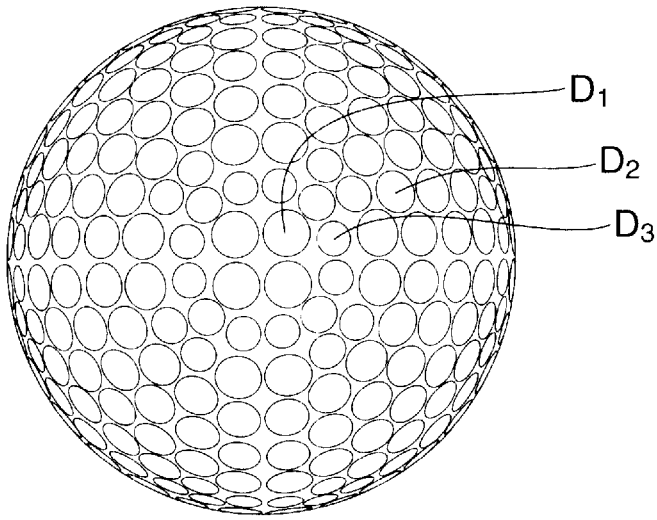
FIG. 16 is a plan view, as seen from the pole direction, showing a golf ball according to a fourth comparative example.
Figure 17:
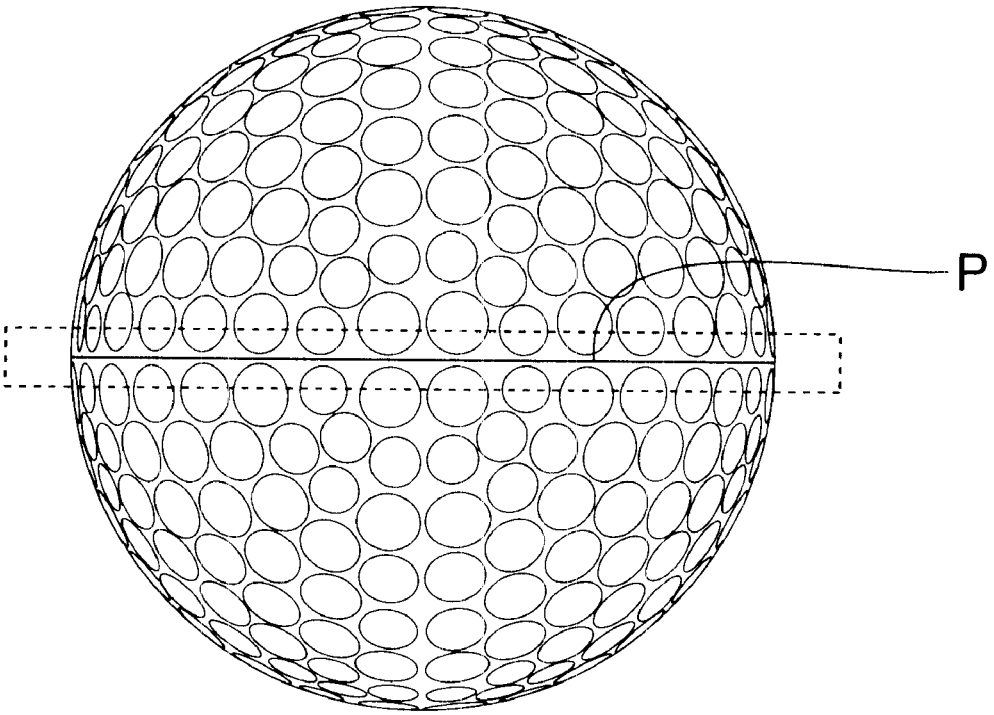
FIG. 17 is a side view of the golf ball shown in FIG. 16.

FIG. 16 is a plan view, as seen from the pole direction, showing a golf ball according to a fourth comparative example of the present invention, and FIG. 17 is a plan view, as seen from the equatorial direction, showing the golf ball shown in FIG. 16. Referring to FIGS. 16 and 17, three types of dimples different in diameter and/or depth, concretely, large dimples $D_1$ (diameter: 4.0 mm, depth: 0.19 mm), medium dimples $D_2$ (diameter: 3.8 mm, depth: 0.18 mm), and small dimples $D_3$ (diameter: 3.2 mm, depth: 0.14 mm) are equally arranged on the surface of a golf ball G in accordance with a known regular octahedron arrangement manner. The total number of the dimples is set to 392.

In the golf ball according to the fourth comparative example, as shown in FIG. 17, any one of the dimples does not intersect with a seam line P. That is to say, the golf ball has a great circle with which any one of the dimples does not intersect. The EAstdev value of the golf ball was calculated in the same manner as that described in the first embodiment. As a result, the EAstdev value was 3.18.

Next, there will be described an experiment in which the golf balls having the dimple arrangements in Embodiments 1 to 4 and Comparative Examples 1 to 4 are produced and then evaluated in terms of the flying performance.

[Experiment]

Two-piece sold golf balls in accordance with Embodiments 1 to 4 and Comparative Examples 1 to 4 were produced as follows:

A rubber material having the following rubber composition was kneaded by a kneading roll and hot-pressed, to prepare a solid core having a diameter of 38.5 mm.

| Rubber Composition | |
|---|---|
| cis-1,4-polybutadiene | 100 parts by weight |
| zinc acrylate | 24 parts by weight |
| zinc oxide | 19 parts by weight |
| anti-aging agent | 1 part by weight |
| dicumyl peroxide | 1 part by weight |

The solid core thus prepared was covered with a cover by injection-molding a cover material mainly containing an ionomer resin around the solid core, to obtain a golf ball having a diameter of 42.7 mm.

On the surface of each of the golf balls thus obtained, dimples whose kinds are shown in Table 1 are arranged in accordance with each of the dimple arrangements shown in FIGS. 2 to 17.

A standard deviation of lift/drag ratios and a standard deviation of flying distances of each of the golf balls thus obtained were evaluated under the following condition. The results are shown in Table 2.

Standard Deviation of Lift/Drag Ratios

Lift-drag force coefficients of a golf ball around random rotational axes passing through the center of gravity of the ball were precisely measured by 30 times indoor under conditions with a Reynolds number of 200000 and a backspin of 42 rps, and a standard deviation of lift/drag ratios (lift force coefficients/drag force coefficients) were calculated. Additionally, the Reynolds number is expressed by [air density×ball velocity×ball diameter (unit: MKS)]/air viscosity coefficient. In this experiment, the air density was 1.179, and the air viscosity coefficient was 0.0000182.

Standard Deviation of Flying Distances

Golf balls of 30 pieces were hit at random at a head speed of 45 m/sec by using a hitting machine on which a driver (#W1) was mounted, and the flying distances of the golf balls were measured and a standard deviation of the flying distances was calculated.

TABLE 2

| | | Example | | | | Comparative Example | | | |
|---|---|---|---|---|---|---|---|---|---|
| | | 1 | 2 | 3 | 4 | 1 | 2 | 3 | 4 |
| Dimple | | | | | | | | | |
| 1 | Diameter (mm) | 3.8 | 3.8 | 3.7 | 4.0 | 3.8 | 3.2 | 4.0 | 4.0 |
| | Depth (mm) | 0.17 | 0.17 | 0.16 | 0.19 | 0.17 | 0.20 | 0.17 | 0.19 |
| | Number | 294 | 282 | 320 | 72 | 282 | 360 | 156 | 72 |
| 2 | Diameter (mm) | 3.2 | 3.2 | 3.2 | 3.8 | 3.2 | 2.4 | 3.6 | 3.8 |
| | Depth (mm) | 0.14 | 0.14 | 0.14 | 0.18 | 0.14 | 0.20 | 0.16 | 0.18 |

TABLE 2-continued

| | Example | | | | Comparative Example | | | |
|---|---|---|---|---|---|---|---|---|
| | 1 | 2 | 3 | 4 | 1 | 2 | 3 | 4 |
| Number | 66 | 78 | 60 | 200 | 78 | 140 | 204 | 200 |
| 3 Diameter (mm) | 2.35 | 2.35 | 2.35 | 3.2 | 2.35 | | 2.4 | 3.2 |
| Depth (mm) | 0.1 | 0.1 | 0.1 | 0.14 | 0.1 | | 0.11 | 0.14 |
| Number | 72 | 72 | 72 | 120 | 72 | | 60 | 120 |
| Total Number of Dimples | 432 | 432 | 452 | 392 | 432 | 500 | 420 | 392 |
| Dimple Arrangement | Icosa-hedron FIGS. 2&3 | Icosa-hedron FIGS. 4&5 | Icosa-hedron FIGS. 6&7 | Random FIGS. 8&9 | Icosa-hedron FIGS. 10&11 | Icosa-hedron FIGS. 12&13 | Icosa-hedron FIGS. 14&15 | Octa-hedron FIGS. 16&17 |
| Number of Great Circles not Intersecting with Dimples | Ab-sence | Pres-ence | Ab-sence | Ab-sence | Pres-ence | Pres-ence | Pres-ence | Pres-ence |
| EAstdev | 0.42 | 1.88 | 0.78 | 0.74 | 2.6 | 2.8 | 9.82 | 3.18 |
| Standard Deviation of Lift/Drag Ratios (X1000) | 3.2 | 4.2 | 3.6 | 3.9 | 4.8 | 5.2 | 6.5 | 5.3 |
| Standard Deviation of Flying Distances | 2.3 | 3.4 | 3.0 | 2.8 | 4.3 | 4.6 | 5.9 | 4.5 |

As is apparent from Table 2, each of the golf balls in Example 1 to 4 was small in both standard deviation of lift/drag ratios and standard deviation of flying distances, and therefore, the golf ball exhibited a uniform flying performance.

The golf ball of the present invention having the above-described configuration is not particularly limited in terms of other constituent elements, and therefore, it is applicable to various kinds of golf balls, for example, a solid golf ball such as a one-piece golf ball, a two-piece golf ball, or a multi-piece golf ball having three or more layers, and a thread wound golf ball. The golf ball of the present invention can be produced from a known material by an ordinary process. It should be noted that the characteristics such as the weight, diameters of a ball can be suitably set under a golf rule.

While the preferred embodiments have been described using the specific terms, such description is for illustrative purposes only, and it is to be understood that changes and variations may be made without departing from the spirit or scope of the following claims.

What is claimed is:

1. A golf ball comprising:

a large number of two types or more dimples different in diameter and/or depth, which are arranged on the surface of said golf ball;

wherein an EAstdev value of said golf ball is in a range of 2 or less, said EAstdev value being expressed by the following equations:

$$EA(\alpha_j) = \sum_{i=1}^{N} [Si \times \sin(\theta_i)]$$

$$EAstdev = \sqrt{\frac{N\sum_{j=1}^{N}[EA(\alpha_j)]^2 - \sum_{j=1}^{N}[EA(\alpha_j)]^2}{N(N-1)}}$$

wherein N is the total number of dimples; each of suffixes "i" and "j" is a dimple ID number; $\alpha_j$ is a rotational axis of a golf ball determined by a straight line connecting the center of the dimple having an ID number "j" to the center of gravity of the golf ball; EA ($\alpha_j$) is an aerodynamic index of a dimple arrangement around the rotational axis $\alpha_j$; $\theta_i$ is an angle formed between the rotational axis $\alpha_j$ of the golf ball and a straight line connecting the center of the dimple having the ID number "i" to the center of gravity of the golf ball; and $S_i$ is an areas of a planar shape formed by a peripheral edge of the dimple having the ID number "i".

2. A golf ball according to claim 1, wherein there is no great circle with which any one of said dimples does not intersect.

3. A golf ball according to claim 1, wherein the total number of said dimples is in a range of 460 or less.

4. A golf ball according to claim 1, wherein said dimples are arranged at random.

5. A method of evaluating a golf ball having on its surface a large number of two types or more dimples different in diameter and/or depth, comprising the steps of:

calculating an EAstdev value of said golf ball; and estimating, if said EAstdev value is 2 or less, that the uniformity of a dimple arrangement of said golf ball is high and thereby an aerodynamic isotropy of said golf ball is good, wherein said EAstdev value is expressed by the following equations:

$$EA(\alpha_j) = \sum_{i=1}^{N} [Si \times \sin(\theta_i)]$$

$$EAstdev = \sqrt{\frac{N\sum_{j=1}^{N}[EA(\alpha_j)]^2 - \sum_{j=1}^{N}[EA(\alpha_j)]^2}{N(N-1)}}$$

wherein N is the total number of dimples; each of suffixes "i" and "j" is a dimple ID number; $\alpha_j$ is a rotational axis of a golf ball determined by a straight line connecting the center of the dimple having an ID number "j" to the center of gravity of the golf ball; EA ($\alpha_j$) is an aerodynamic index of a dimple arrangement around the rotational axis $\alpha_j$; $\theta_i$ is an angle formed between the rotational axis $\alpha_j$ of the golf ball and a straight line connecting the center of the dimple having the ID number "i" to the center of gravity of the golf ball; and $S_i$ is an areas of a planar shape formed by a peripheral edge of the dimple having the ID number "i".

* * * * *